US006059149A

United States Patent [19]

Kanzler et al.

[11] Patent Number: 6,059,149

[45] Date of Patent: May 9, 2000

[54] MULTI BAGGING MACHINE

[75] Inventors: Estacia R. Kanzler; James J. Kanzler, both of Round Lake; Jack D. Eiler, Ingleside, all of Ill.

[73] Assignee: The Sandbagger Corporation, Wauconda, Ill.

[21] Appl. No.: 09/058,424

[22] Filed: Apr. 9, 1998

Related U.S. Application Data

[63] Continuation-in-part of application No. 08/585,219, Jan. 11, 1996, Pat. No. 5,740,950.

[51] Int. Cl.[7] ..... G01F 11/20

[52] U.S. Cl. ..... 222/238; 222/334; 222/559; 222/179; 141/313

[58] Field of Search ..... 222/238, 413, 222/333, 334, 179, 559; 141/313, 391, 68, 247

[56] References Cited

U.S. PATENT DOCUMENTS

| | | |
|---|---|---|
| 3,111,242 | 11/1963 | Reed . |
| 3,258,165 | 6/1966 | Guyer . |
| 5,417,261 | 5/1995 | Kanzler et al. . |
| 5,437,318 | 8/1995 | Kanzler et al. . |
| 5,740,950 | 4/1998 | Kanzler et al. . |

*Primary Examiner*—Philippe Derakshani
*Attorney, Agent, or Firm*—Thomas R. Vigil

[57] ABSTRACT

The multi bagging machine comprises: a framework including four, spaced apart upright legs arranged in a generally rectangular configuration; a generally rectangular hopper mounted to an upper end of the framework; the hopper including a sharply inclined front wall and a lesser inclined back wall extending between two end walls; an auger located adjacent the bottom of the hopper and having an auger shaft extending between the end walls; an agitator including an agitator shaft located above the auger and a short distance toward the rear of the hopper; a plurality of discharge chutes connected to the bottom of the hopper for discharging fluent particulate material from the hopper into a container or bag; and a slide gate movable from one wall of each discharge chute into and across the discharge chute to an opposite wall of each discharge chute and back for blocking and unblocking the flow of fluent particular material through the discharge chute into a bag or container. Preferably, the slide gates are located as high as possible, the discharge chutes are located as far forward as possible, the auger shaft is driven at a faster speed than the agitator shaft, the agitator blades are skew to the agitator shaft and are parallel to each other and the agitator shaft is located such that the outer point of rotation of each agitator blade is the same distance from the front wall and as it is from the rear wall.

18 Claims, 6 Drawing Sheets

MULTI BAGGING MACHINE

CROSS REFERENCED TO RELATED APPLICATIONS

This application is a continuation-in-part of U.S. application Ser. No. 08/585,219, filed on Jan. 11, 1996 for APPARATUS AND AGITATOR FOR DISPENSING FLUENT MATERIAL INTO CONTAINERS, now U.S. Pat. No. 5,740,950, granted Apr. 21, 1998.

BACKGROUND OF THE INVENTION

1. Field of the Invention

The present invention is directed to a machine for the multi bagging of particulate fluent material. More specifically, the present invention is directed: to a multi bagging machine which includes an elongate hopper and discharge chutes located at the bottom of the hopper and which utilizes slide gates located as close to a feed auger as possible for controlling the dispensing of particulate fluent material from the discharge chutes and prevent clogging of the chutes; to separate drive mechanisms for driving an auger shaft and an agitator shaft, the latter at a slower speed to facilitate flow of the fluent particulate material in the hopper; to a plurality of reverse direction auger flights for improving flow of particulate fluent material to each discharge chute; to agitator blade configuration, alignment and size to improve agitation of the fluent material; to a semi-circular bottom trough closely adjacent the auger flights for minimizing clogging of the auger; and, to positioning of the discharge chutes as close to a front side of the hopper as possible to facilitate ease of use by a user and to offset auger delivery of fluent material to the chutes to inhibit clogging of the auger and chutes.

2. Description of the Prior Art

Heretofore, various types of machines for filling bags with fluent particulate material, such as sand, have been proposed. More specifically, sandbagging machines have been proposed for bagging sand and other particulate fluent material. Several examples of previously proposed fluent material dispensing machines are disclosed in U.S. Pat. Nos. 5,437,318 and 5,417,261, the disclosures of which are incorporated herein by reference.

In the Kanzler et al, U.S. Pat. No. 5,417,261 there is disclosed an apparatus for dispensing fluent material into containers, where swing gates are pivotally mounted to discharge chutes for swinging or pivotal movement between an open position and a closed position under a discharge opening at the lower end of each discharge chute. The swing gate is connected to a linkage mechanism which is operable by a foot pedal for opening and closing the associated chute for dispensing fluent material from the discharge chute into a container such as a bag.

The Kanzler et al, U.S. Pat. No. 5,437,318 discloses a fluent material dispensing apparatus including a hopper with inclined front and rear walls which converge to a generally flat bottom that has a plurality of discharge chutes extending downwardly therefrom. An auger is positioned along the bottom of the hopper above the discharge chutes for moving particulate fluent material, such as sand, across open upper ends of the discharge chutes for assisting in the dispensing of the fluent material from the discharge chutes.

Also, In the Kanzler et al. U.S. Pat. No. 5,740,950, there is disclosed a fluent material dispensing apparatus having an agitator shaft with agitating blades mounted thereon positioned above the auger shaft in the hopper.

SUMMARY OF THE INVENTION

According to the present invention there is provided a multi bagging machine comprising: a framework including four, spaced apart upright legs arranged in a generally rectangular configuration; a generally rectangular hopper mounted to an upper end of the framework; the hopper including a sharply inclined front wall and a lesser inclined back wall extending between two end walls; an auger located adjacent the bottom of the hopper and having an auger shaft extending between the end walls; an agitator including an agitator shaft located above the auger and a short distance toward the rear of the hopper; a plurality of discharge chutes connected to the bottom of the hopper for discharging fluent particulate material from the hopper into a container or bag; and a slide gate movable from a rear wall of each discharge chute into and across the discharge chute to a front wall of each discharge chute and back for blocking and unblocking the flow of fluent particular material through the discharge chute into a bag or container.

Preferably, the slide gates are located as high as possible, the discharge chutes are located as far forward as possible, the auger shaft is driven at a faster speed than the agitator shaft and the agitator blades are skew to the agitator shaft, and are parallel to each other and the agitator shaft is located such that the outer point of rotation of each agitator blade is the same distance from the front wall as it is from the rear wall.

DESCRIPTION OF THE PREFERRED EMBODIMENT(S)

Figure 1:
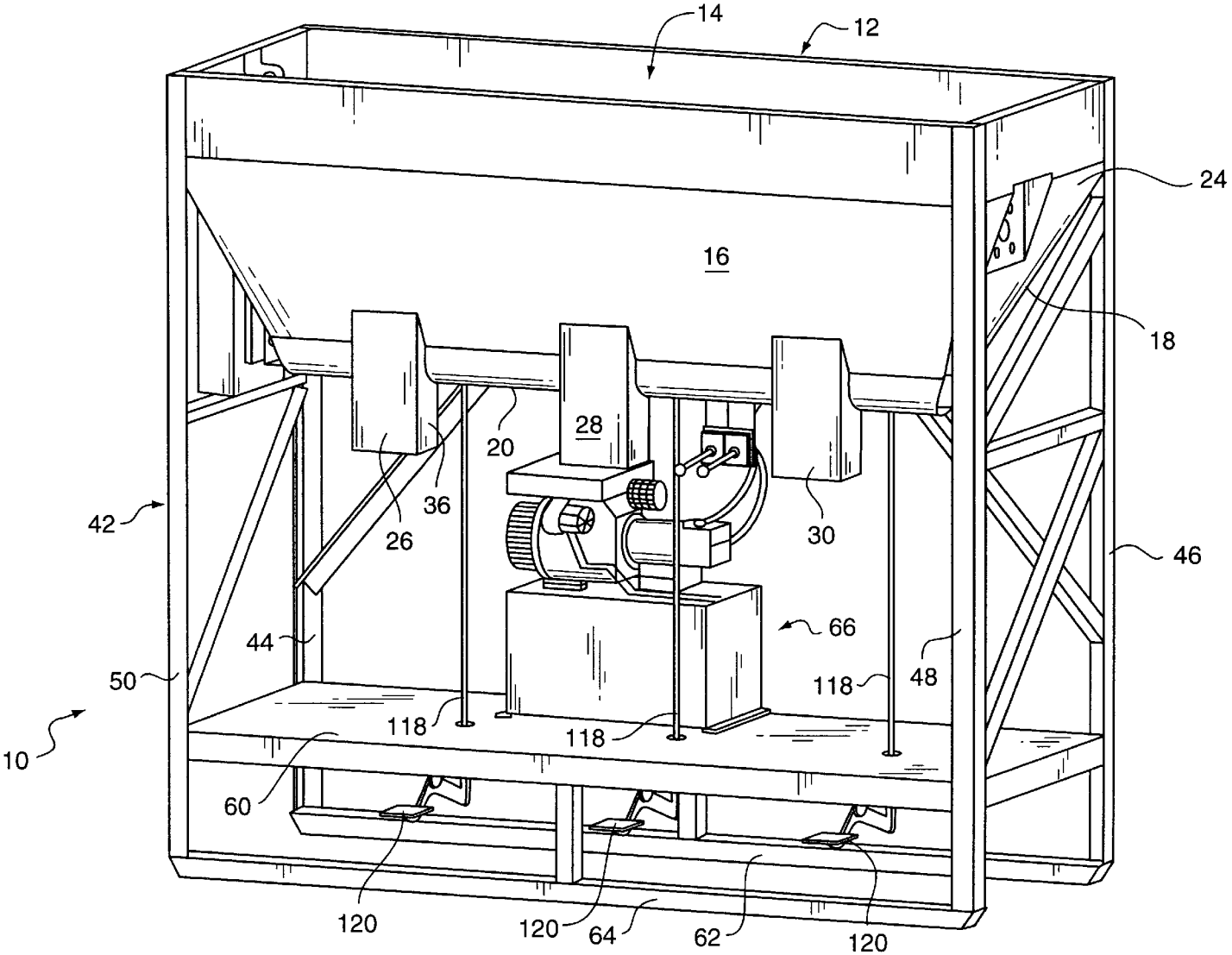
FIG. 1 is a front perspective view of a multi bagging machine constructed according to the teachings of the present invention.
Figure 3:
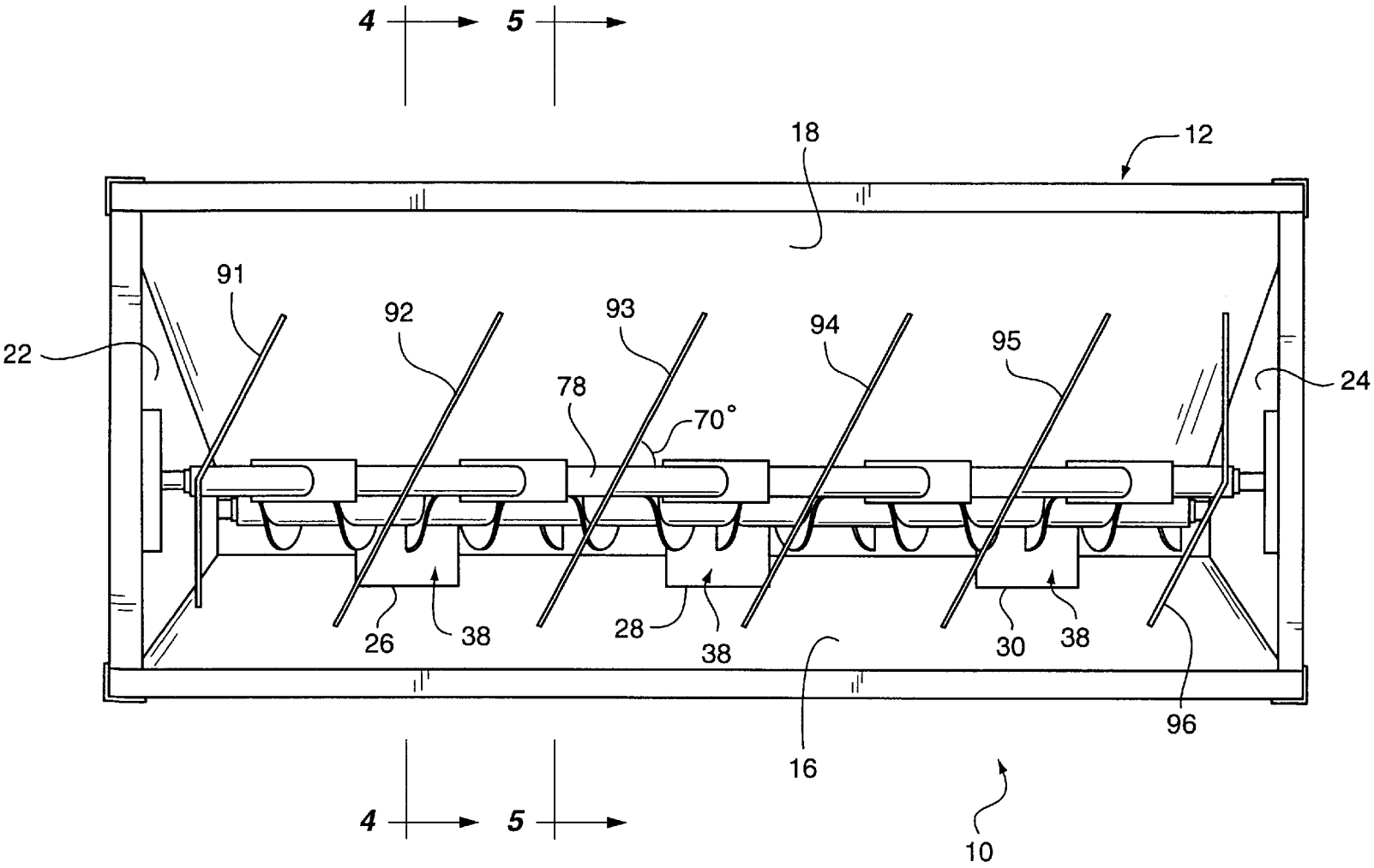
FIG. 3 is a top plan view of the multi bagging machine and shows the interior of the hopper of the machine and the auger and agitator mounted therein and is taken along line 3—3 of FIG. 2.

Referring now to the drawings in greater detail, there is illustrated in FIG. 1, the multi bagging machine 10 of the present invention. The machine 10 includes a hopper 12 having a generally rectangular upper open end 14 and elongate, inclined front and rear inclined walls 16 and 18 (FIG. 3), which converge downwardly toward each other in a generally V configuration to a rounded, partially circular in-cross-section, bottom wall 20. The walls 16 and 18 extend between slightly inclined end walls 22 and 24 (FIG. 3).

Figure 4:
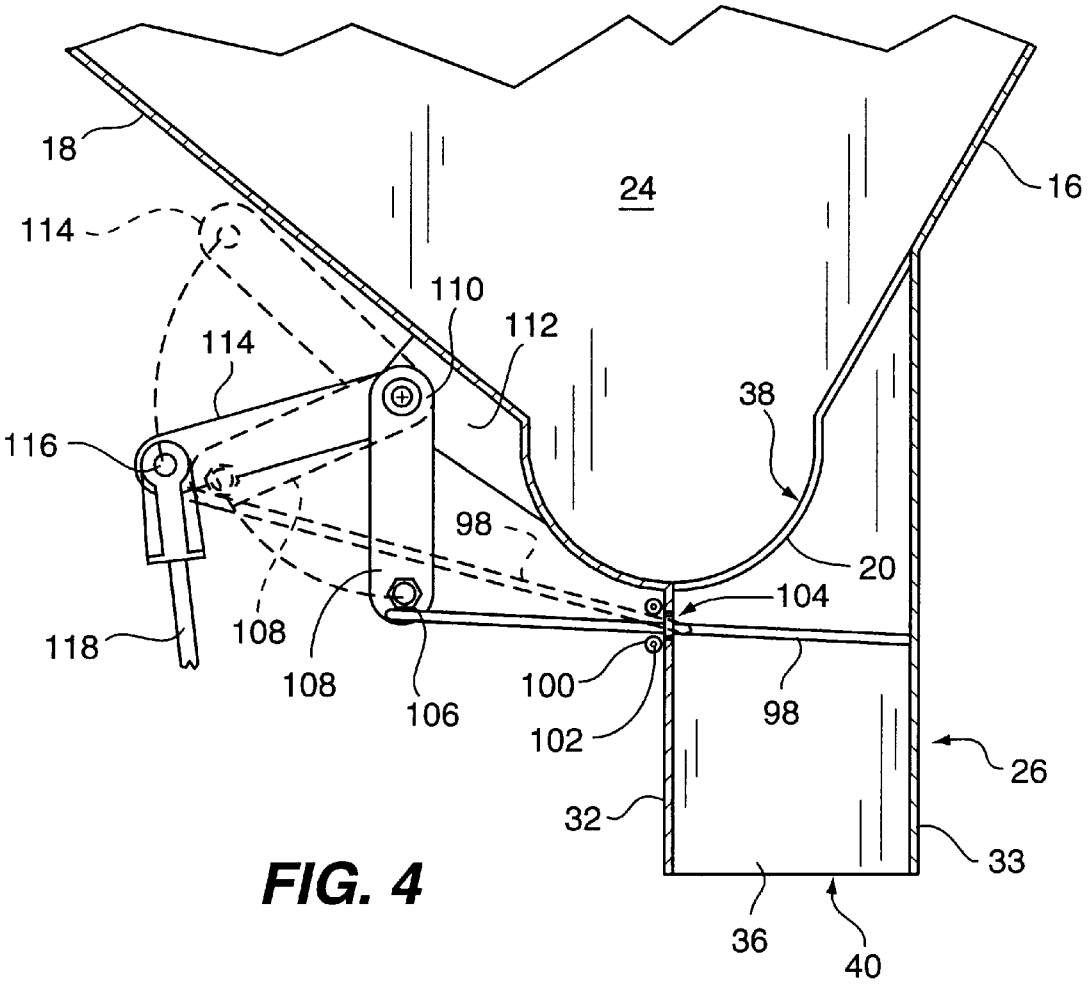
FIG. 4 is a sectional view of the hopper shown in FIG. 3 without the auger and agitator being shown but showing a slide gate in a material discharge or dispensing chute and is taken along line 4—4 of FIG. 3.

As shown in FIG. 1, spaced along the rounded bottom wall 20 of the hopper 12 are a plurality of, and in the illustrated embodiment, three, discharge chutes 26, 28 and 30 which are coupled to and extend downwardly from the hopper front wall 16 and downwardly from the bottom wall 20 in an offset arrangement, as shown in FIG. 4.

Referring to FIG. 4, there is shown a front-to-rear cross section of the chute 30. Each chute 26, 28 and 30 has a short rear wall 32 extending downwardly from the middle of the rounded bottom wall 20, a longer front wall 33 and spaced apart end walls 34 and 36 with an inclined open upper end 38 and a lower outlet end 40. This configuration of each chute 26, 28 and 30 places each chute closer to the front side of the machine to facilitate use by a user and to inhibit clogging of flights of an auger 41 (FIG. 3) and clogging of the chutes 26, 28 and 30.

Referring now again to FIG. 1, it will be understood that the hopper 12 is supported at the upper end of a generally rectangular framework 42 including four (4) upright legs 44, 46, 48, and 50, interconnected by transversely extending struts. Then, at a distance below the lower outlet ends 40 of the discharge chutes 26, 28 and 30 is located a table or platform 60 that extends between and is connected to the four legs 44–48 a short distance above ground level. At the bottom of each pair of front and rear legs 44, 46 or 48, 50 is a bottom rail 62, 64 for supporting the machine on a generally level surface.

Referring again to FIG. 1 and FIG. 2 there is mounted on the platform 60 a 30 power source 66 for the auger 41 and an agitator 68 (FIG. 3). The power source 66 comprises a gasoline engine which drives a hydraulic pump which drives two hydraulic motors and, as shown in FIG. 1, control handles are provided for controlling power to and the direction of rotation of the auger 41 and the agitator 68. Typically, each handle has three (3) positions; a forward position, a neutral position and a reverse position.

Figure 2:
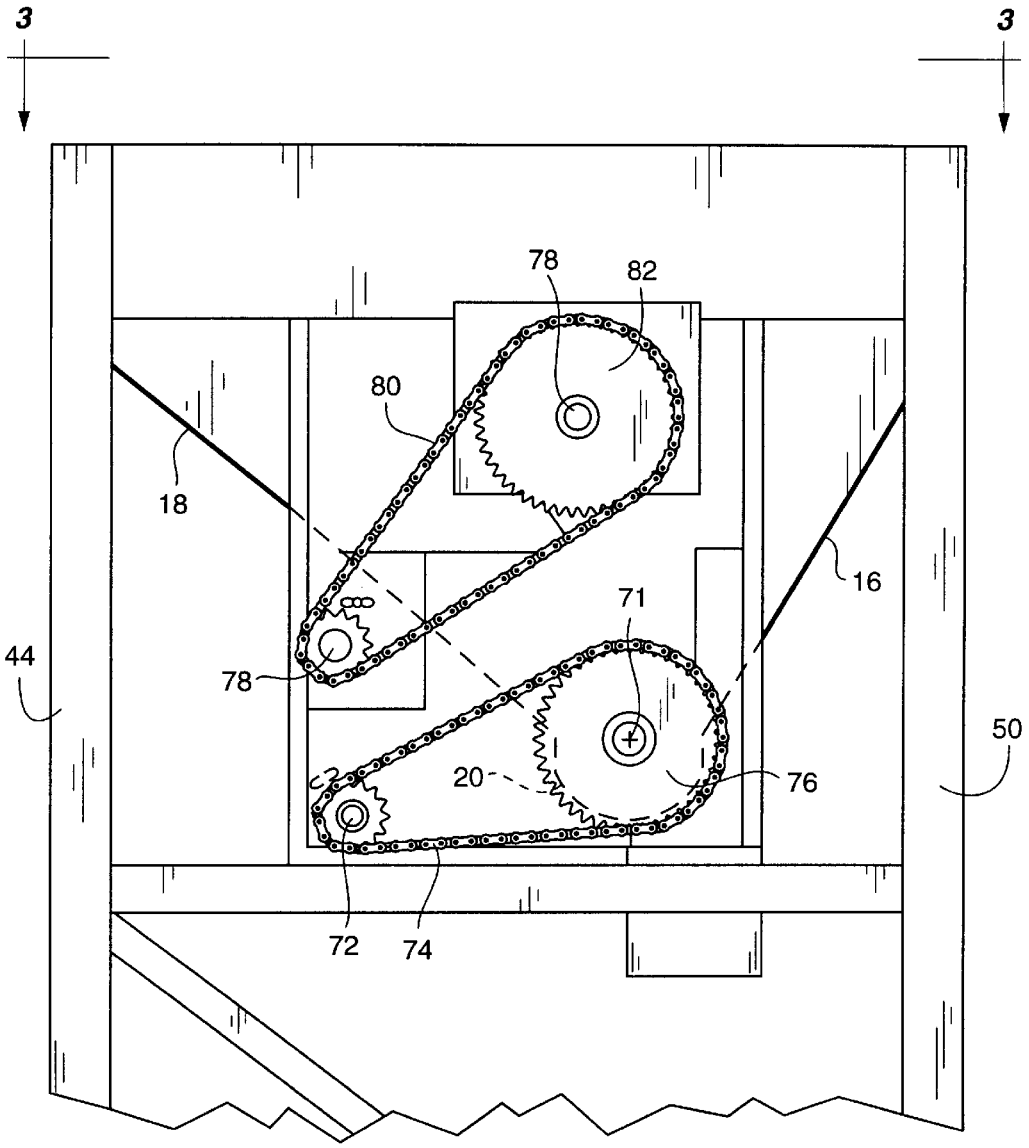
FIG. 2 is a side elevational view, with portions broken away, of drive mechanisms for an auger shaft and for an agitator shaft used in the multi bagging machine shown in FIG. 1.

As shown in FIG. 2, an auger shaft 71 is driven by an hydraulic motor through a sprocket 72, a chain 74 and a larger driven wheel or sprocket 76 mounted on the shaft 71. Likewise as shown in FIG. 2 an agitator shaft 78 is driven from an hydraulic motor through a small sprocket 80, a chain 82 and a larger driven wheel or sprocket 84 mounted on the agitator shaft 78.

According to the teachings of the present invention, each shaft 71 and 78 is driven by a separate hydraulic motor and at a different speed. The auger shaft 71 is driven at a speed of between 16 and 24 rpm., preferably 18 rpm., and the agitator is driven at a lower speed between 8 and 12 rpm., and preferably 10 rpm. Empirical tests have shown that the different speeds provide a desired enhanced flow of material through the hopper 12, especially where the material is compost material including stringy vegetation material.

As shown in FIG. 3 the hopper 12 has an off set shape with the front wall 16 being shorter than the rear wall 18 between the pair of opposed end walls 22 and 24. As a result, there is more material to the front of the hopper 12 than the rear side of the hopper 12 and the front wall 16 has a sharper incline to the vertical than the rear wall 18. Also, the axis of the auger shaft 71 is off set from the axis of the agitator shaft 78, i.e. upwardly and slightly to the rear. Ideally the outer ends of agitator blades 92–95 of the blades 91–96 will be spaced the same distance from each wall 16 and 18 as the blades 91–96 rotate.

Also, from FIG. 3 it will be noted that the plurality of agitator blades 91–96 are mounted on the agitator shaft 78 and are situated skew to the agitator shaft 78. In this respect, the blades 92–95 are at positioned at an acute angle of 50° to 80°, preferably 70° to the agitator axis of the shaft 78 and arranged parallel to one another. Further, at each end of the agitator shaft 78, the agitator blade 91 or 96 has one portion that extends parallel to the adjacent end wall 22 or 24 and another portion that extends parallel to the other blades 92–95.

According to the teachings of the present invention, and with reference to FIG. 4, each chute 26–30 has a generally planar, slide gate 98 supported on a pair of side-to-side rollers 100 mounted on a shaft 102 extending between each pair of end walls 34 and 36. The rollers 100 are located at the lower side of a slot 104 in the rear wall 33 which receives the slide gate 98.

Each slide gate 98 is pivotally connected at an outer end 106 to a first link 108 which in turn is pivoted at its upper end 110 to a bracket or plate 112 mounted to the underside of the inclined hopper wall 18. Another link 114, which is fixed to the link 108 in a generally V configuration at its pivot connection to the bracket plate 112, extends outwardly from the bracket plate 112 to a pivot connection 116 to a linkage rod 118. Movement of the linkage rod 118 upwardly causes upward movement of the V-shaped arrangement of the links 108 and 114 so as to move the links 108 and 114 to the position shown in phantom, where the slide gate 98 is moved out of the chute 26, 28 or 30 to allow fluent particular material, such as sand, to fall through the chute 26, 28 or 30 into a container or bag disposed beneath the bottom end 40 of the chute 26, 28 or 30. The linkage rod 118 can be coupled to a foot pedal 120, as shown in FIG. 1, so that an operator can operate the slide gate 98 by foot while holding the top end of the container, such as a bag, beneath the chute lower opening 40 for filling the container or bag.

According to the teachings of the present invention, the slide gate 98 is mounted as high as possible relative to the rounded wall 20 and return to the chute upper open end 38 to minimize the space that could become clogged in each chute 26, 28 or 30.

Figure 5:
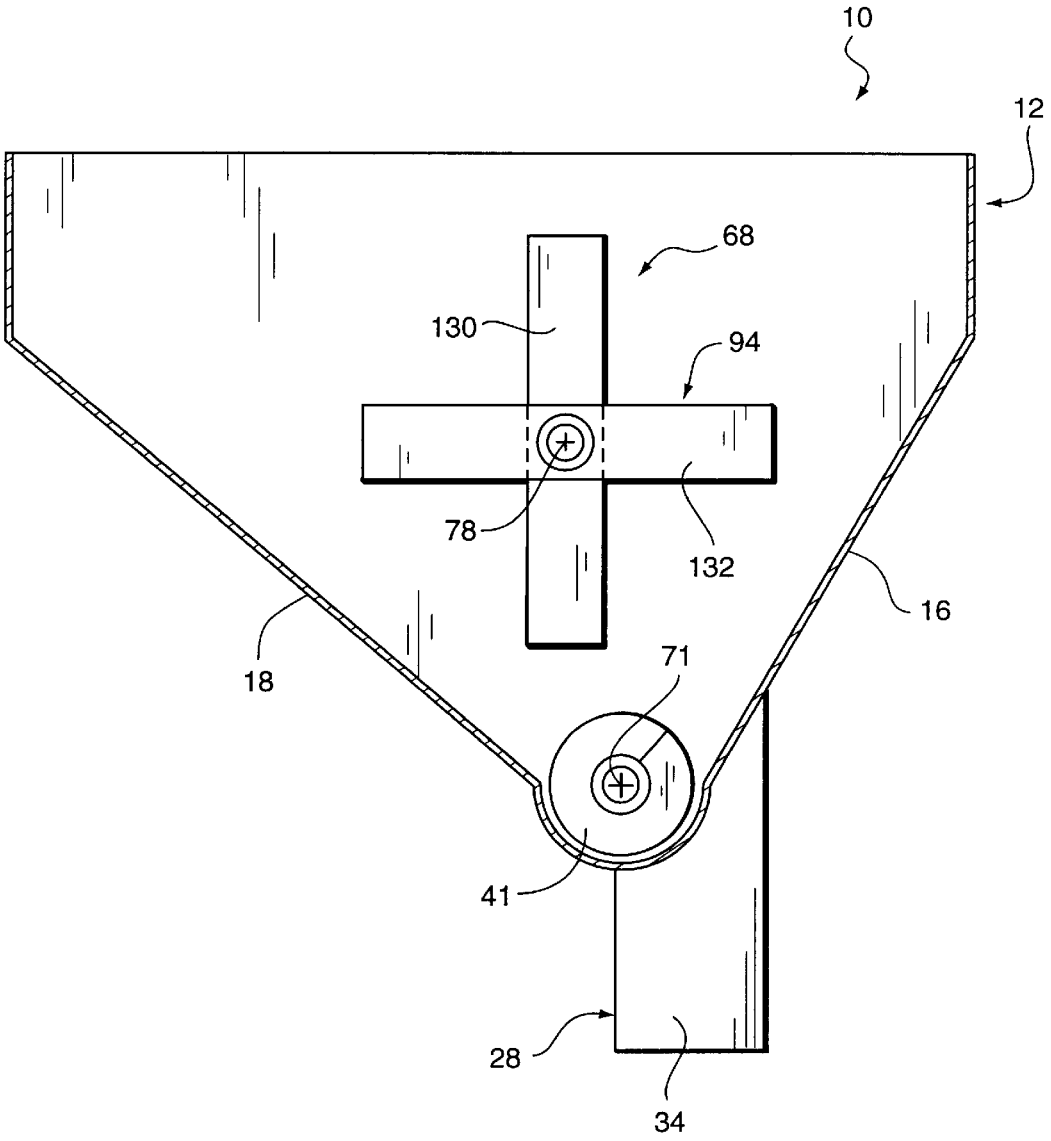
FIG. 5 is a vertical sectional view of the hopper shown in FIG. 3 and is taken along line 5—5 of FIG. 3 and shows the orientation of agitator blades on the agitator shaft in the hopper.

In FIG. 5 is illustrated a plan view of one of the agitator blades 92–95 which has two cross members 130 and 132 in the form of a cross or + and which are located in a plane which is at an acute angle of 70° to the agitator shaft 78.

Figure 6:
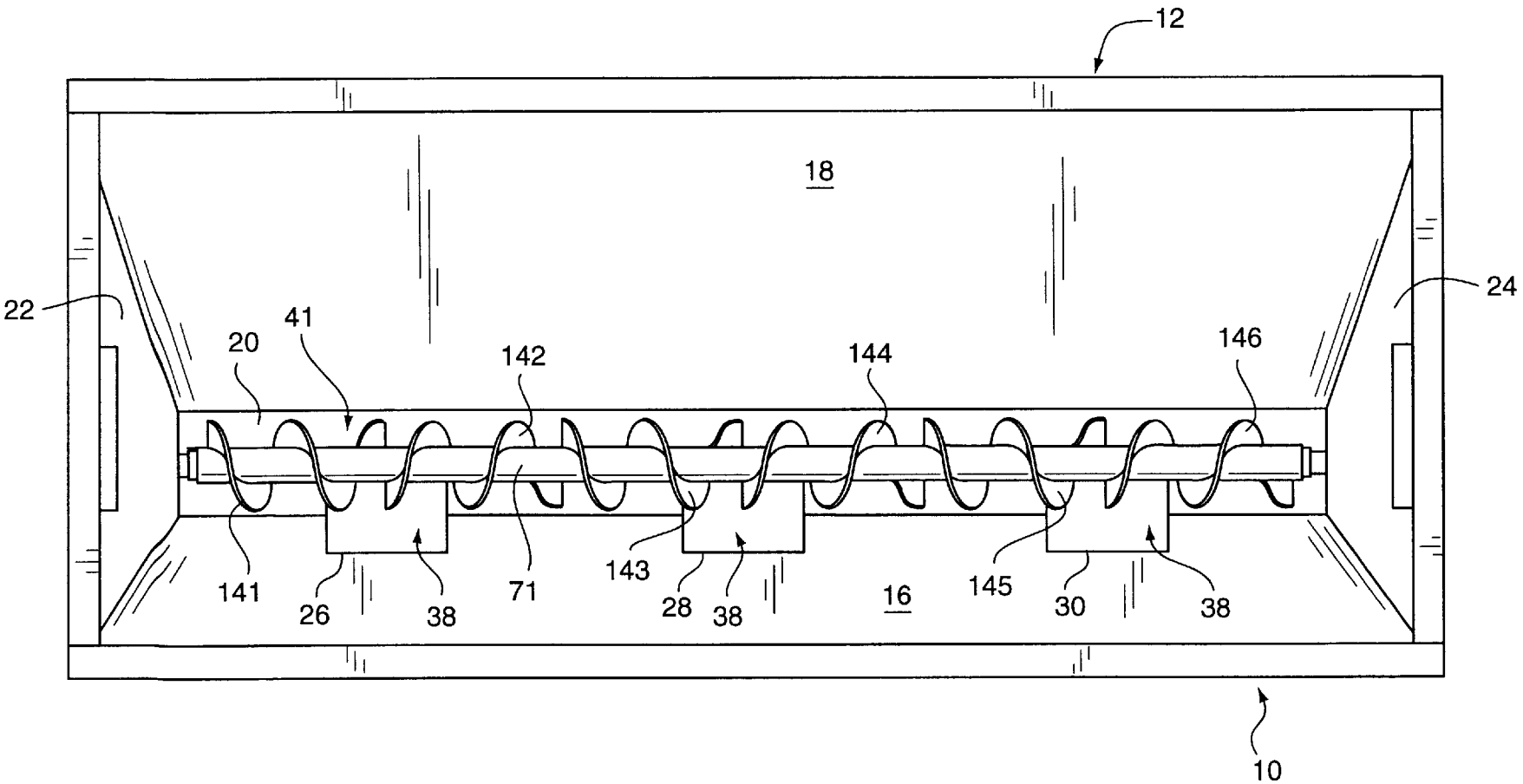
FIG. 6 is a top plan view of the hopper similar to the view shown in FIG. 3 but without showing the agitator and shows the six auger flights.

FIG. 6 shows the auger shaft 71 as including six (6) discontinuous auger flights 141–146 the flights 141, 143 and 145 are disposed at one spiral angle and extend from a point at one side of a chute upper opening 38 to a middle are of a chute upper opening 38. Then 180° around the shaft 71 one of the other flights 142, 144 or 146 each having a reverse spiral angle extends to a point away from chute opening 38 and to an adjacent auger flight 141, 143 or 145. In this respect, each auger flight 141, 143 and 145 includes two revolutions in one spiral direction and an adjacent auger flight 142, 144 or 146 has two revolutions in an opposite spiral direction. In this way, fluent particular matter, such as sand, is caused to move to the center of each chute upper opening 38 at the top end of each chute upon forward rotation of the auger shaft 71.

From the foregoing description, it will be apparent that the multi bagging machine of the present invention has a number of advantages, some of which have been described above and others of which are inherent in the invention. Also, modifications can be made to the multi bagging machine without departing from the teachings of the invention. Accordingly, the scope of the invention is only to be limited as necessitated by the accompanying claims.

We claim:

1. In a multi bagging machine comprising: a framework including four, spaced apart upright legs arranged in a generally rectangular configuration; a generally rectangular hopper mounted to an upper end of said framework; said hopper including a sharply inclined front wall and a lesser inclined back wall extending between two end walls; an auger located adjacent the bottom of said hopper and having an auger shaft extending between said end walls; an agitator including an agitator shaft located above said auger and a short distance toward the rear of said hopper; a plurality of discharge chutes connected to the bottom of said hopper for discharging fluent particulate material from said hopper into a container or bag; the improvement residing in a slide gate movable from one wall of each discharge chute into and across said discharge chute to an opposite wall of each discharge chute and back for blocking and unblocking the flow of fluent particular material through said discharge chute into a bag or container and said one wall of each discharge chute having a slot therein for receiving said slide gate.

2. The multi bagging machine of claim 1 wherein said one wall of each discharge chute has roller means adjacent a lower edge of said slot for facilitating movement of said slide gate into and out of said discharge chute.

3. In a multi bagging machine comprising: a framework including four, spaced apart upright legs arranged in a generally rectangular configuration: a generally rectangular hopper mounted to an upper end of said framework: said hopper including a sharply inclined front wall and a lesser inclined back wall extending between two end walls, an auger located adjacent the bottom of said hopper and having an auger shaft extending between said end walls; an agitator including an agitator shaft located above said auger and a short distance toward the rear of said hopper; a plurality of discharge chutes connected to the bottom of said hopper for discharging fluent particulate material from said hopper into a container or bag; the improvement residing in said auger including a plurality of pairs of auger flights, each pair of auger flights including a first flight section having a spiral angle in one direction and a second flight section having a reverse spiral angle, the ends of the spiral in each adjacent flight section in each pair being spaced 180 degrees from each other around said auger shaft and the junction between auger flight sections being situated over the middle of one of said discharge chutes whereby the first auger flight section moves fluent particulate material towards the middle of said discharge chute and the second auger flight section moves particulate fluent material in an opposite direction towards the middle of said discharge chute.

4. The multi bagging machine of claim 3 wherein three discharge chutes are provided and six auger flight sections are provided.

5. In a multi bagging machine comprising: a framework including four, spaced apart upright legs arranged in a generally rectangular configuration; a generally rectangular hopper mounted to an upper end of said framework; said hopper including a sharply inclined front wall and a lesser inclined back wall extending between two end walls, an auger located adjacent the bottom of said hopper and having an auger shaft extending between said end walls; an agitator including an agitator shaft located above said auger and a short distance toward the rear of said hopper; a plurality of discharge chutes connected to the bottom of said hopper for discharging fluent particulate material from said hopper Into a container or bag; the improvement residing in said agitator comprising a plurality of spaced apart agitator blades, each blade being located in a plane traversing said agitator shaft that has an acute angle with said agitator shaft between 50 and 80 degrees.

6. The multi bagging machine of claim 5 wherein said acute angle is approximately 70 degrees.

7. The multi bagging machine of claim 5 wherein each agitator blade has an outer point of rotation which lies in an imaginary plane which extends 90 degrees to said agitator shaft and which contains an outer point of rotation of an adjacent agitator blade.

8. The multi bagging machine of claim 5 including agitator end blades each including a portion that extends parallel to said other agitator blades and a portion which is located in an imaginary plane which extends 90 degrees to the axis of the agitator shaft.

9. The multi bagging machine of claim 5 wherein said agitator shaft is located such that the outer point of rotation of each agitator blade is the same distance from said front wall and as it is from said rear wall.

10. In a multi bagging machine comprising: a framework including four, spaced apart upright legs arranged in a generally rectangular configuration; a generally rectangular hopper mounted to an upper end of said framework; said hopper including a sharply inclined front wall and a lesser inclined back wall extending between two end walls; an auger located adjacent the bottom of said hopper and having an auger shaft extending between said end walls; an agitator including an agitator shaft located above said auger and a short distance toward the rear of said hopper; a plurality of discharge chutes connected to the bottom of said hopper for discharging fluent particulate material from said hopper into a container or bag; the improvement residing in said agitator shaft being driven by a first hydraulic motor and said auger shaft being driven by a second hydraulic motor hereby, the speed of rotation of the auger shaft being different than the speed of rotation of the agitator shaft.

11. The multi bagging machine of claim 10 wherein said auger shaft is driven at a speed between 40 and 50 rpm.

12. The multi bagging machine of claim 11 wherein said auger shaft is driven at a speed of approximately 45 rpm.

13. The multi bagging machine of claim 10 wherein said agitator shaft is driven at a speed between 8 and 12 rpm.

14. The multi bagging machine of claim 13 wherein said agitator shaft is driven at a speed of approximately 10 rpm.

15. The multi bagging machine of claim 1 wherein said one wall is a rear wall and said opposite wall is a front wall.

16. In a multi bagging machine comprising: a framework including four, spaced apart upright legs arranged in a generally rectangular configuration; a generally rectangular hopper mounted to an upper end of said framework; said hopper including an inclined front wall and an inclined back wall extending between two end walls; an auger located adjacent the bottom of said hopper and having an auger shaft extending between said end walls of said hopper; a plurality of discharge chutes connected to the bottom of said hopper for discharging fluent particulate material from said hopper into a container or bag; the improvement residing in a slide gate movable from one wall of each discharge chute into and across said discharge chute to an opposite wall of each discharge chute and back for blocking and unblocking the flow of fluent particular material through said discharge chute into a bag or container and said one wall of each discharge chute having a slot therein for receiving said slide gate.

17. The multi bagging machine of claim 16 wherein said one wall of each discharge chute has roller means adjacent a lower edge of said slot for facilitating movement of said slide gate into and out of said discharge chute.

18. In a multi bagging machine comprising: a framework including four, spaced apart upright legs arranged in a generally rectangular configuration: a generally rectangular hopper mounted to an upper end of said framework: said hopper including an inclined front wall and an inclined back wall extending between two end walls, an auger located adjacent the bottom of said hopper and having an auger shaft extending between said end walls; a plurality of discharge chutes connected to the bottom of said hopper for discharging fluent particulate material from said hopper into a container or bag; the improvement residing in said auger including a plurality of pairs of auger flights, each pair of auger flights including a first flight section having a spiral angle in one direction and a second flight section having a reverse spiral angle, the ends of the spiral in each adjacent flight section in each pair being spaced 180 degrees from each other around said auger shaft and the junction between auger flight sections being situated over the middle of one of said discharge chutes whereby the first auger flight section moves fluent particulate material towards the middle of said discharge chute and the second auger flight section moves particulate fluent material in an opposite direction towards the middle of said discharge chute.

* * * * *